US006121864A

United States Patent [19]

Tillmann

[11] Patent Number: 6,121,864

[45] Date of Patent: Sep. 19, 2000

[54] SECURITY SWITCH AND METHOD FOR INSTALLATION THEREOF

[76] Inventor: Ronald Edmund Tillmann, 184 E. Heron Rd., Holland, Pa. 18966

[21] Appl. No.: 09/280,958

[22] Filed: Mar. 29, 1999

[51] Int. Cl.[7] ..... H01H 9/00; G08B 13/12

[52] U.S. Cl. ..... 335/205; 340/548; 200/61.14; 200/61.18; 200/61.93

[58] Field of Search ..... 340/545.1, 546, 340/547, 548; 200/61.13, 61.14, 61.18, 61.41, 61.84, 61.93; 335/205–208

[56] References Cited

U.S. PATENT DOCUMENTS 3,932,718 1/1976 Porat ..... 200/61.93

*Primary Examiner*—Michael L. Gellner
*Assistant Examiner*—Raymond Barrera
*Attorney, Agent, or Firm*—William H. Meise

[57] ABSTRACT

An electrical switch includes a magnetically actuated switch (16), such as a reed switch, and a permanent magnet (10). A path defining arrangement (14) is mechanically coupled (by track follower 210) to the permanent magnet, for allowing the magnet to move in a defined path. A particular part of the path lies adjacent to a portion of the reed switch. The particular part (218) of the path is close enough to the reed switch to actuate the switch. Consequently, or whereby, the magnet, at a particular position along the path will cause the reed switch to assume one of first (open) and second (closed) states. In a particular embodiment of the invention, the magnet, when at the particular position along the path, causes a normally-open switch to close. An energy storage arrangement is coupled to at least the magnet, for urging the magnet toward one end (220) of the path. In the particular embodiment, the energy storage arrangement is coupled to the magnet by way of a track follower (210). An elongated, nonelastic flexible actuator (24) is coupled to the magnet, for, in use, applying tension to the magnet in a direction (to the right in the illustrations) which urges the magnet toward the other end of the path. This flexible actuator may be a filament such as a fishing line. A removable holding arrangement (250, 510) is associated with the path defining arrangement, for holding the magnet in the particular part of the path. This is particularly advantageous during setup of the switch.

10 Claims, 6 Drawing Sheets

SECURITY SWITCH AND METHOD FOR INSTALLATION THEREOF

FIELD OF THE INVENTION

This invention relates to electrical switches, and more particularly to electrical switches useful in security systems.

BACKGROUND OF THE INVENTION

In the field of security systems, intrusion into a secured area can be detected in a number of ways. Once an intruder is within the protected premises, acoustic and infrared sensors can be used to detect motion of the intruder, and to sound an alarm. However, it is desirable to sound an alarm at the time of the initial breach of the perimeter of the protected premises.

Various techniques are used to sound an alarm when an intruder enters a building by way of a protected access point. Such an access point might be a door or a window. Window break alarms include electrically conductive tape applied to the surface of the window to be protected, and the ends of the tape are connected to an electrical monitor which detects a breaking of the circuit, which may occur if the window is broken. This technique is effective, but may not be useful in those cases in which a window is left open, or in which application of the tape is inconvenient. Sound based window breakage alarms monitor the acoustic environment within a building, and react to sounds which approximate those associated with a window being broken. Such acoustic alarms need to maintain a memory of various possible acoustic signatures, and to filter the ambient noise looking for such signatures. This may be complex and costly.

One common way to protect access points on the perimeter of a building is by means of switches arranged to change state in the event that a window, door, or other access point is breached. A switch can be associated with a door or window to trigger an alarm if the door or window is opened.

In some cases, there is a possibility that a window may be broken out, rather than opened. This possibility is greatest with windows which are near ground level, such as basement windows, which are often casement types. Such windows are often protected by a "barrier bar," which is an elongated, spring-loaded, expansible bar or tube, similar to a curtain rod with a an internal spring. The barrier bar is cut to size, and assembled with the spring inside, and mounted across the inside of the aperture in which a window is located, and bearing against a switch. The switch is maintained in one of its two states by the pressure applied by the barrier bar. An electrical circuit monitors the state of the electrical switch, to sound an alarm or give a signal in the event that the state of the switch changes. An attempt to enter the protected premises by way of the window protected by the switch/barrier bar arrangement will, if all goes well, result in displacing the barrier bar, which removes the spring pressure holding the switch in its first state, and causing the switch to assume its second state, thereby sounding the alarm.

The barrier bar is somewhat effective, but suffers from the disadvantage of being timeconsuming to install, in that the barrier bar must be custom-sized to the window, which may require arriving at the site at which a barrier bar is to be installed with a full-length barrier bar, disassembling the barrier bar so as to be able to cut it to proper size, and then reassembling it. In use, the protection afforded by the barrier bar can be reduced if the person attempting entry knows of its existence. That person can simply apply sufficient pressure to the barrier bar in the direction of the switch to maintain the state of the switch, while moving the bar aside so as to enable entry.

Another type of protective arrangement for such windows is one in which a switch located adjacent the window to be protected is maintained in a given state by a washer or spacer located between pincers. A string or thread is attached to the washer or spacer, and strung across the window opening. A person attempting entry will, it is hoped, press on the thread, and thereby pull the spacer out of the switch, thereby sounding the alarm. This arrangement is somewhat easier to install than the barrier bar, but is subject to being defeated by simply cutting the thread.

SUMMARY OF THE INVENTION

An electrical switch according to an aspect of the invention includes a magnetically actuated switch, such as a reed switch, and a permanent magnet. A path defining arrangement is mechanically coupled to the permanent magnet, for allowing the magnet to move in a defined path. A particular part of the path lies adjacent to a portion of the reed switch. The particular part of the path is close enough to the reed switch to actuate the switch. Consequently, or whereby, the magnet, at a particular position along the path will cause the reed switch to assume one of first and second states. In a particular embodiment of the invention, the magnet, when at the particular position along the path, causes a normally-open switch to close. An energy storage arrangement is coupled to at least the magnet, for urging the magnet toward one end of the path. In the particular embodiment, the energy storage arrangement is coupled to the magnet by way of a track follower. An elongated, nonelastic flexible actuator is coupled to the path defining arrangement, for, in use, applying tension to the path defining arrangement in a direction which urges the path defining arrangement toward the other end of the path. This flexible actuator may be a filament such as a fishing line. A removable holding arrangement is associated with the path defining arrangement, for holding the magnet in the particular part of the path. This is particularly advantageous during setup of the switch.

The track, in one embodiment, is a raised ridge, which engages a slot in a track follower, and the magnet is mounted on or in the track follower. A preferred embodiment has a straight track. In the preferred embodiment, the energy storage arrangement includes a coil spring bearing on the track follower and on a bearing surface fixed near an end of the path.

A method for installing an electrical switch which includes (a) a magnetically actuated reed switch, (b) a permanent magnet, (c) a path defining arrangement mechanically coupled to the permanent magnet for allowing the magnet to move in a defined path, a particular part of which path lies adjacent to a portion of the reed switch, which particular part is close enough to the reed switch to actuate the switch, whereby the magnet, at a particular position along the path will cause the reed switch to assume one of first and second states, (d) an energy storage arrangement coupled to at least the magnet for urging the magnet toward one end of the path, (e) an elongated, nonelastic flexible actuator coupled to the path defining arrangement, for, in use, applying tension to the path defining arrangement in a direction which urges the path defining arrangement toward the other end of the path, and (f) a removable holding arrangement associated with the path defining arrangement, for holding the magnet in the particular part of the path, includes the steps of (A) mounting the switch to a fixed structure adjacent the opening to be protected, (B) extending the filament across at least a portion of the opening, and fastening the remote end of the filament to a fixed structure, and (C) removing the removable arrangement. A particular mode of the method includes the further step of extending the filament around at least one low-friction arrangement and across another portion of the opening.

DESCRIPTION OF THE INVENTION

Figure 1:
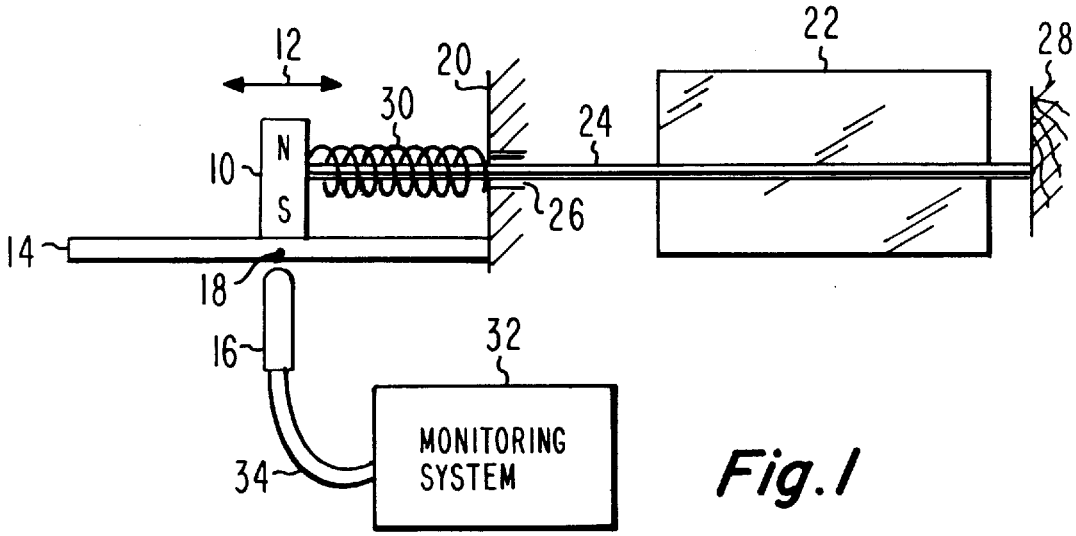
FIG. 1 is a simplified representation of a security system in accordance with an aspect of the invention, to illustrate the principles of the invention.

FIG. 1 is a simplified representation of a security system in accordance with an aspect of the invention, to illustrate the principles of the invention In FIG. 1, a magnet 10 is movable in the direction of double-headed arrow 12 on a rail 14 which acts as a path along which the magnet is constrained to run. A magnetically actuated switch 16 is located adjacent a selected position 18 of the track 14. Selected position 18 is one in which the magnet 10 is not at an end of the rail 14, but is instead one at which magnet 10 is capable of moving in both directions. Rail 14 is affixed to a fixed structure 20 adjacent a window or other opening 22 to be protected. A nonelastic filament or thread 24 is affixed to magnet 10, and extends through an aperture 26 in structure 20, across window opening 22, and is affixed to a further fixed structure 28, such as a window frame. An energy storage device, illustrated as a coil spring 30, is located between magnet 10 and fixed structure 20, and is normally in a compressed state, so as to urge the magnet to the left in FIG. 1.

In the illustrated state of the arrangement of FIG. 1, the spring 30 urges the magnet 10 to the left, but the magnet cannot move to the left without stretching filament 24, which is assumed to be substantially nonelastic and therefore cannot be stretched, at least with forces which are reasonable in this context. The magnet 10 cannot move to the left in FIG. 1 without stretching the filament 24, and cannot move to the right without application of sufficient force to the filament to overcome the leftdirected force of spring 30. Consequently, the magnet 10 remains in the illustrated position, at or near location 18, which is adjacent the fixed position of magnetically actuated switch 16. Consequently, under the illustrated conditions, the arrangement of FIG. 1 will maintain the switch 16 under the influence of magnet 10, and a monitoring system 32 connected to switch 16, as by wires illustrated as 34, will see a constant state of the switch. To be more specific, if magnetically actuated switch 16 is a normally-open (NO) reed switch, meaning a switch which in the absence of a sufficiently strong magnetic field leaves the electrical contacts open or noncontacting, the presence of magnet 10 at location 18 holds switch 16 in the closed or conducting state.

If someone attempting to enter the window 22 of FIG. 1 cuts filament 24, the force opposing the urging of spring 30 is removed, and spring 30 causes magnet 10 to move to the left, away from location 18. The movement of magnet 10 away from location 18 reduces the magnetic forces acting on switch 16, allowing the contacts of the switch to return to their normal state, which is the open condition. In that event, monitoring system 32 will see a change of state of the switch, from the closed condition to the open condition, as an emergency condition, and an alarm is sounded. On the other hand, if someone attempting to enter window 22 simply attempts entry without cutting the filament 24, forces are applied to the filament 24 which tend to "stretch" the filament. However, the filament 24 does not stretch very much, so the filament 24 pulls the magnet to the right in FIG. 1, against the force of the spring 30. It should be understood that the presence of the spring 30 tends to mask the actual forces involved in the process, since application of force tending to "stretch" the filament 24 merely increases the tension force in the filament 24 sufficiently to overcome the incremental compressive force of spring 30. Thus, the actual differences in force required to move the position of magnet 10 from location 18 to another location are quite small. In any case, attempting to push past the filament 24 in window 22 tends to move the magnet to the right in FIG. 1, away from location 18. This movement, in turn, reduces the magnetic influence of magnet 10 on switch 16, allowing switch 16 to assume its normally open condition. The open condition is again detected as a fault or emergency condition by monitoring system 32. Thus, pushing on filament 24, or cutting it, have the same effect, namely that of moving magnet 10 away from position 18 at which it maintains a given state of the switch 16, with the ultimate result that the alarm is sounded.

It has been discovered that setup of a protective device such as that described in principle in conjunction with FIG. 1 can be difficult or time-consuming, because the proper position of magnet 10 adjacent to location 18 can only be maintained when the force of spring 30 urging the magnet to the left is equal to the tension in the filament 24. During set-up, it has been found to be difficult to affix the filament to a fixed element, such as element 28 of FIG. 1, while maintaining the correct tension. This can be readily understood by considering how difficult it is to tie off a rope while maintaining a particular tension therein.

Figure 2B:
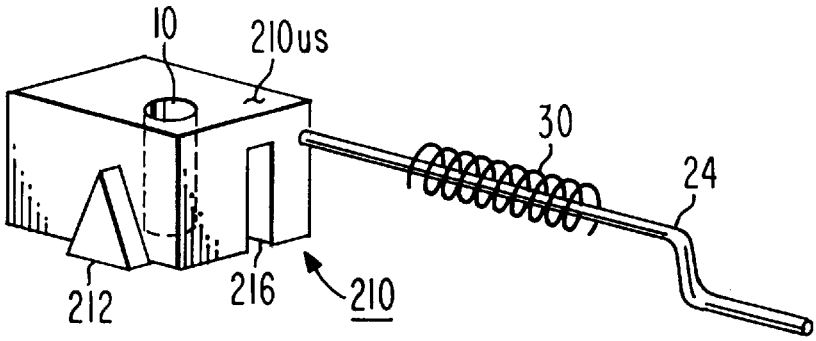
FIG. 2*b* is a simplified view of the track follower or magnet carriage of FIG. 2*a*.
Figure 2A:
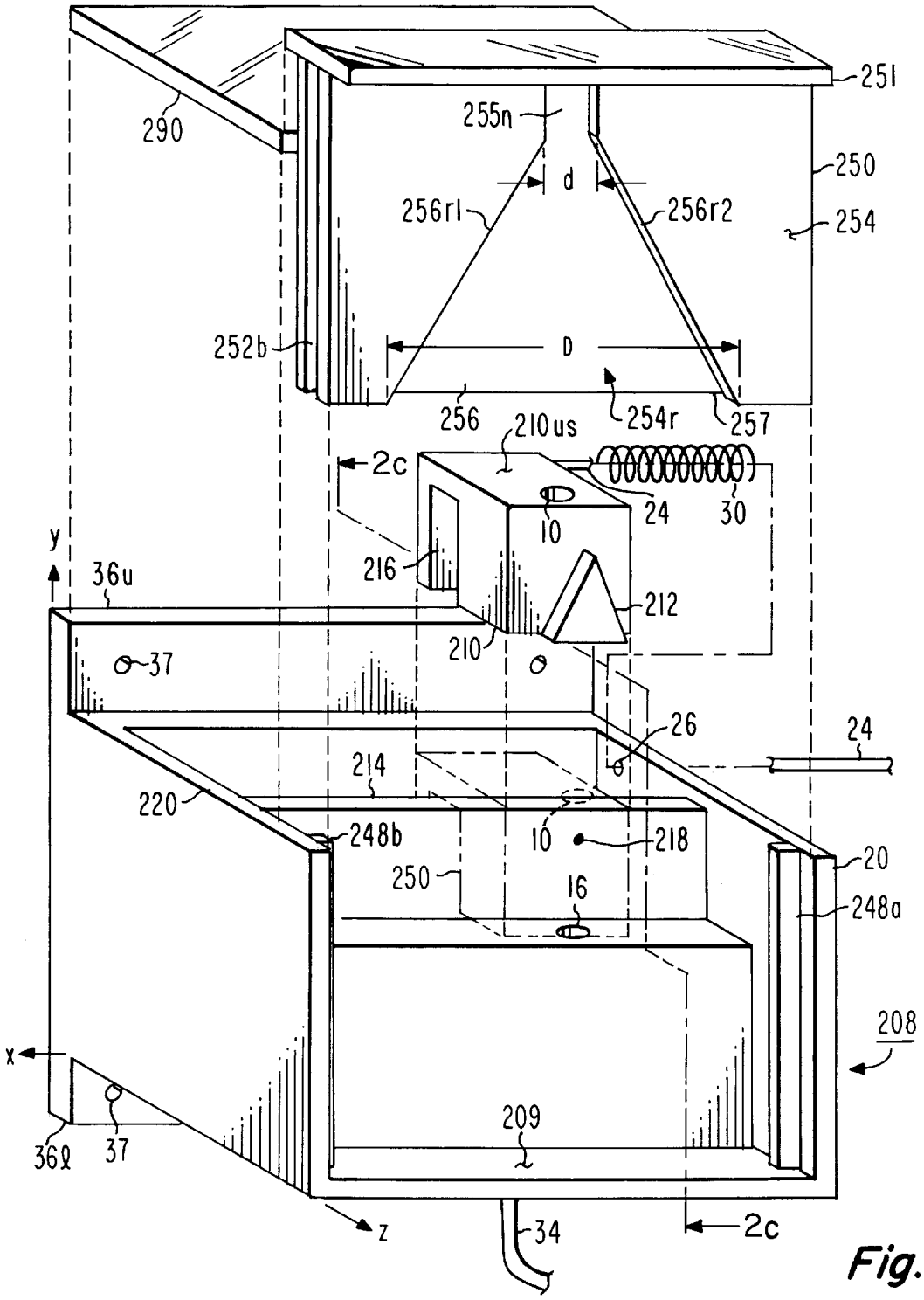
FIG. 2*a* is a simplified, partially exploded, perspective or isometric view of a portion of a structure embodying an aspect of the invention including a housing defining a track or path and a magnet carriage or track follower, the obverse side of an aligning device, and a cover.
Figure 2D:
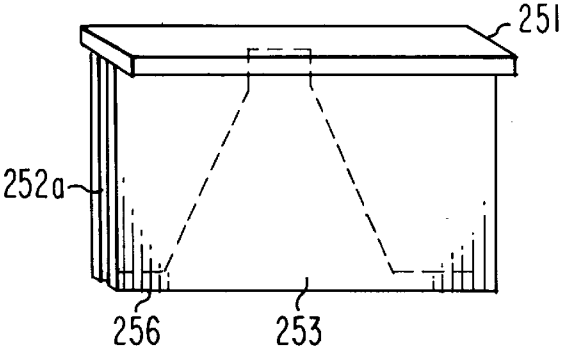
FIG. 2*d* is a perspective or isometric view of the reverse side of the aligning device of FIG. 2*a*.
Figure 2E:
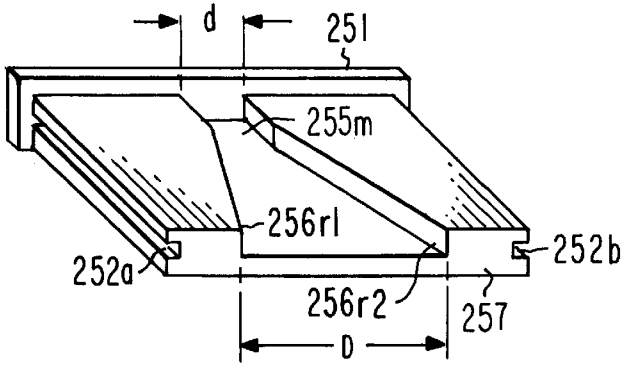
FIG. 2*e* is a perspective or isometric view of the obverse side of the alignment device of FIG. 2*a;*
Figure 2C:
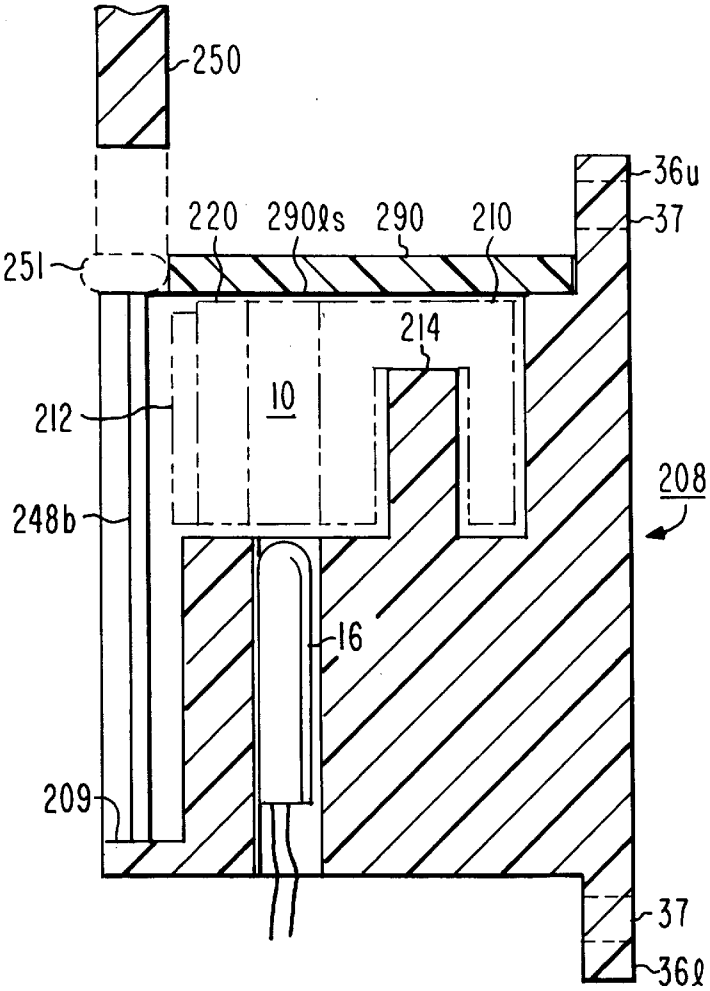
FIG. 2*c* is a cross-section of the body portion of FIG. 2*a*, looking in the direction of section lines 2*c*—2*c*.

FIG. 2*a* is a simplified perspective or isometric view of a portion of a structure embodying an aspect of the invention including a housing or body 208 defining a mounting flange set including an upper mounting flange 36*u* and a lower mounting flange 36*l*, each provided with mounting screw clearance apertures, some of which are designated 37. Body 208 also defines a track, slide or path 214. Track 214 extends from a first fixed wall 20 of body 208 to a second fixed wall 220, which is parallel with wall 20. The arrangement of FIG. 2*a* includes a magnet carriage or track follower 210, an aligning device 250, and a cover 290. FIG. 2*b* is a simplified view of the track follower or magnet carriage 210 of FIG. 2*a*. FIG. 2*c* is a cross-section of body portion 208 of FIG. 2*a*, looking in the direction of section lines 2*c*—2*c*. FIG. 2*d* is a perspective or isometric view of the reverse side of the alignment device 250 of FIG. 2*a*, and FIG. 2*e* is a perspective or isometric view of the obverse side of the alignment device 250 of FIG. 2*a*. In FIGS. 2*a*, 2*b*, 2*c*, 2*d*, and 2*e*, track follower 210 defines a slot 216, which is dimensioned to fit over the rectangular track 214 defined by body 208. Track follower 210 contains magnet 10, which is located on the near side of track follower 210 relative to slot 216, in the illustrated position of track follower 210. As illustrated in FIGS. 2*a* and 2*c*, body 208 defines vertically-oriented projecting rails or tracks 248*a* and 248*b*, on either side of walls 20 and 220, respectively.

When the track follower 210 in FIGS. 2*a*, 2*b*, and 2*c* has its slot 216 mounted on track 214 of body 208, the upper surface 210us of track follower 210 lies below the bottom or lower surface 290*ls* of cover or lid 290, so that the track follower 210 is free to slide on track 214. Thus, track follower 210 can take a position adjacent wall 20, or against wall 220, or anywhere between. When track follower 210 has its magnet 10 adjacent location 218 of FIG. 2*a*, the magnet influences the magnetically actuated switch 16, which in this embodiment is preferably a reed switch, to close the normally open contacts. When track follower 210 moves away from that position which places its magnet 10 away from location 218, the magnetic field of magnet 10 which influences switch 16 is reduced in magnitude, and at some position of the track follower 210, the switch 16 resumes its normally open condition. Thus, at the center position 218, the track follower 210 and magnet 10 maintain the switch closed, and movement in either direction can be expected to give a signal by allowing the switch contacts to close.

As illustrated in FIG. 2*a*, a nominally nonelastic or nonstretching string, thread, or filament 24 is affixed to track follower 210, extends through the axis of a coil spring 30, and through an aperture 26 in side wall of body 208. The length of the free end of filament 24 may be of any suitable length, with a length sufficient to extend several times across the width of the window to be protected, with some excess for making a fixed connection. Such a length might be, for a 24-inch window, eleven feet.

As illustrated in FIGS. 2*a* and 2*c*, body 208 defines vertically-oriented projecting rails or tracks 248*a* and 248*b*, on either side of walls 20 and 220, respectively. A generally flat alignment piece 250, illustrated in FIGS. 2*a*, 2*c*, 2*d*, and 2*e*, has an enlarged top 251. Alignment piece 250 also defines vertically oriented (in the FIGURES) grooves 252*a* and 252*b*, which are dimensioned to allow alignment piece 250 to slide up and down along the rails 248*a* and 248*b*. Alignment piece 250 has one essentially flat broad side 253, and the other broad side 254 defines a "ramp" or "funnel" arrangement 254*r*. Alignment piece 250 is purposely made so as to be reversible in position, so that it may be slid onto the rails 248*a*, 248*b* with either the ramp side 254 or the flat side 253 facing inward, toward the track 214 and track follower 210.

Referring to FIGS. 2*a* and 2*e*, ramp or funnel 254*r* of alignment piece 250 includes a depressed narrow neck region 255*n* having a neck dimension d, and also includes a depressed portion 256, defined by sides 256*r*1 and 256*r*2, which tapers from a dimension D at an edge 257 to dimension d at neck region 255*n*.

As illustrated in FIGS. 2*a* and 2*b*, track follower 210 defines a triangular protrusion or boss 212, with an apex of the protrusion pointed upward. This protrusion 212 is used, together with the ramp 254*r* portion of the alignment device 250, as an aid in alignment of the apparatus in readiness for use. Protrusion 212 protrudes sufficiently to engage the depressed portion 256 of ramp 254*r* when the alignment device 250 is slid onto the rails 248*a*, 248*b* with the ramp facing inward.

Figure 3A:
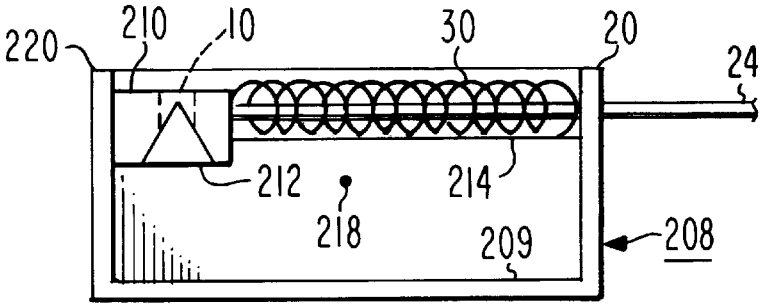
FIGS. 3*a*, 3*b*, 3*c*, and 3*d* are simplified frontal views of the arrangement of FIG. 2*a* in a partially assembled form, which together illustrate various steps involved in setup of the structure of FIGS. 2*a*, 2*b*, 2*c*, 2*d*, and 2*e* according to an aspect of the invention.

FIGS. 3*a*, 3*b*, 3*c*, 3*d*, 3*e*, and 3*f* are simplified frontal views of the arrangement of FIG. 1*a* in a partially assembled form, which together illustrate various steps involved in setup of the structure of FIGS. 2*a*, 2*b*, 2*c*, 2*d*, and 2*e* according to an aspect of the invention. In FIG. 3*a*, the location of the track follower 212 is illustrated as being all the way to the left, under the influence of the force of spring 30 unopposed by any tension in the filament 24, which is slack. The spring 30 is in its most extended state. This is the condition when the device is about to be mounted to a structure adjacent to the window. The alignment device 250 may be absent, or its grooves 252*a*, 252*b* may be on the rails 248*a*, 248*b* of body 208 in the condition in which the flat side 253 (FIG. 2*d*) faces inward, toward the track follower. With the flat side 253 inward, the alignment device 250 has no influence on the position of the track follower 210.

Figure 3B:
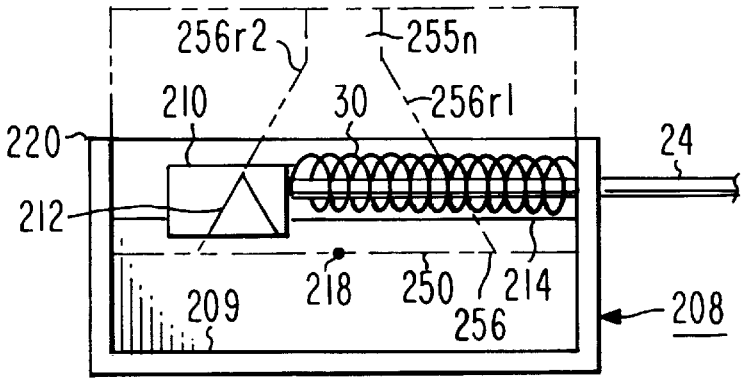

When the body 208 of FIG. 3*a* has been affixed to a structure adjacent the window or other opening to be protected, as by the use of mounting screws extending through holes 37 in flanges 36*u* and 36*l* (FIG. 2*a*), the next step can be taken, which is to begin to slide the grooves 252*a*, 252*b* of alignment device 250 onto the rails 248*a*, 248*b*, with the ramp or funnel 254*r* (FIG. 2*a*) facing inward, so that the ramp side 256*r*2 can engage with protruding boss 212, and to begin to move the boss 212, and the track follower 210, to the right, as illustrated in FIG. 3*b*. In the illustration, the condition with the ramp 254*r* facing inward corresponds to engagement of rail 248*a* with groove 252*b*, and rail 248*b* with groove 252*a*. The act of pushing the alignment device 250 down onto the rails tends to produce an effect like that of an inclined plane, by which relative motion of the ramp 256*r*2 against track follower 210 boss 212 results in motion of the track follower and boss to the right, and also results in substantial compression of spring 30.

Figure 3C:
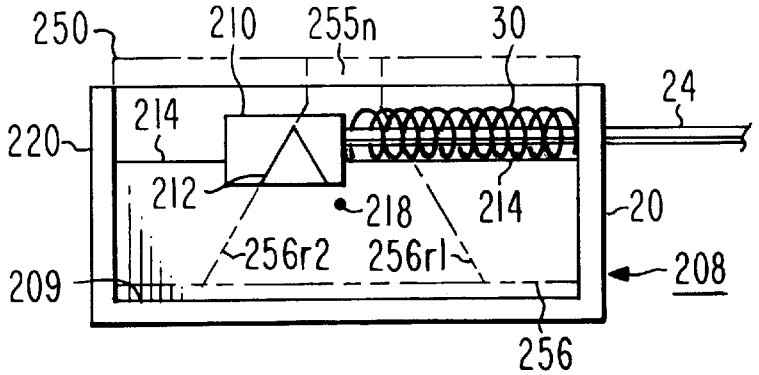

FIG. 3*c* illustrates a condition in which the alignment device is pushed further downward, retaining its engagement with the rails 248*a*, 248*b*. In the position of the alignment device 250 which is illustrated in FIG. 3*c*, with the lower edge 256 of the alignment device near the bottom of the body 208, the boss 212 of track follower 210 is almost in the neck portion 255*n* of the ramp 254*r*, and the track follower is almost centered along the track 214.

Figure 3D:
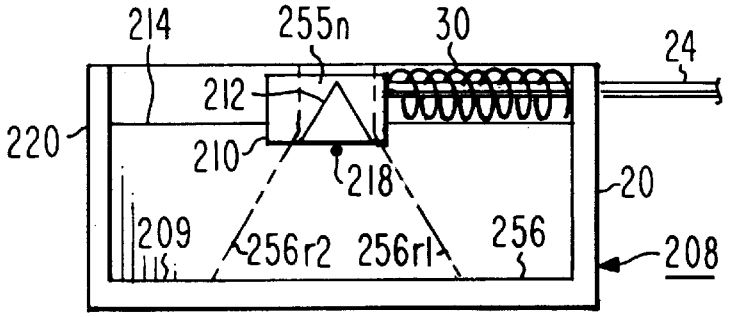

FIG. 3*d* illustrates a condition in which the alignment device is pushed fully downward along rails 248*a*, 248*b*, with its lower edge 256 against the interior bottom 209 of the body 208. In the position of the alignment device 250 which is illustrated in FIG. 3*d*, with the lower edge 256 of the alignment device essentially in contact with the inside bottom 209 of the body 208, the boss 212 of track follower 210 is fully in the neck portion 255*n* of the ramp 254*r*, and the track follower is fully centered along the track 214. With the track follower fully centered, the spring 30 is half-compressed. The magnet 10 (not illustrated in FIG. 3*d*) is centered adjacent to the reed switch 16 (also not illustrated in FIG. 3*d*). With the magnet centered relative to the reed switch, the reed switch is fully within the influence of the magnetic field of magnet 10, and assumes one of its states, which in the preferred embodiment of the invention is a contact-closed condition of a normally-open switch configuration.

Figure 4A:
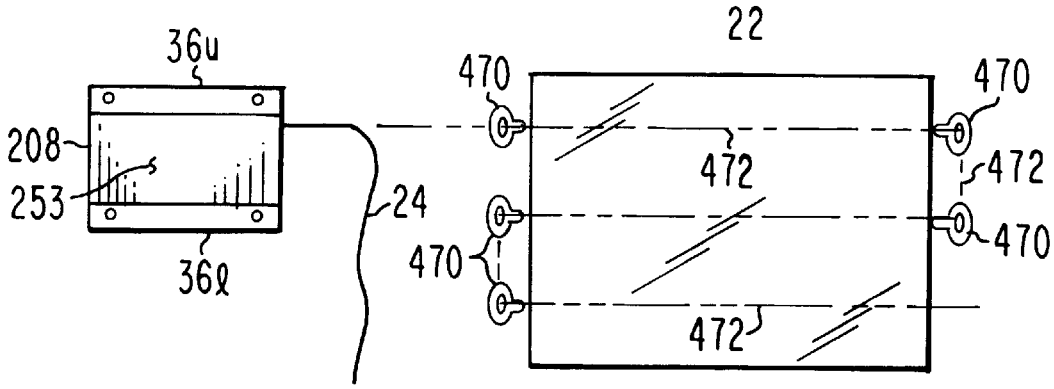
FIGS. 4*a*, 4*b*, and 4*c* are views of the electrical switch arrangement illustrating steps according to an aspect of the invention.
Figure 4B:
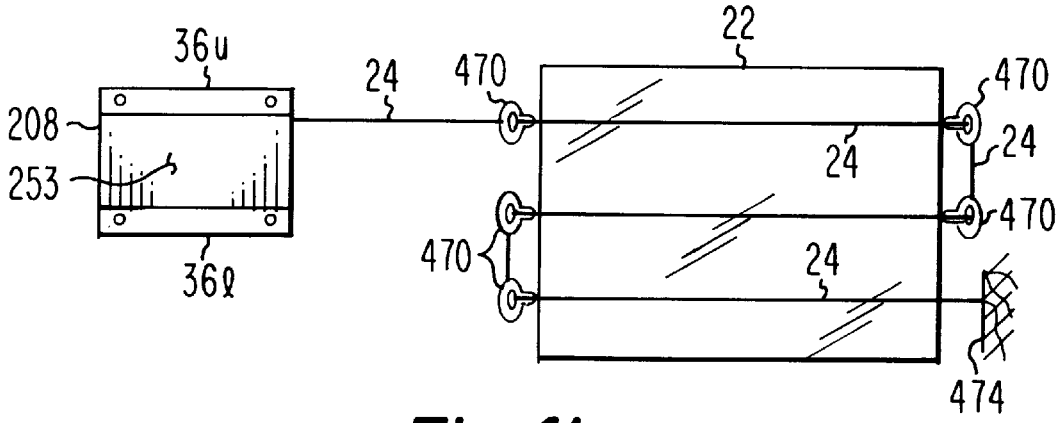
Figure 4C:
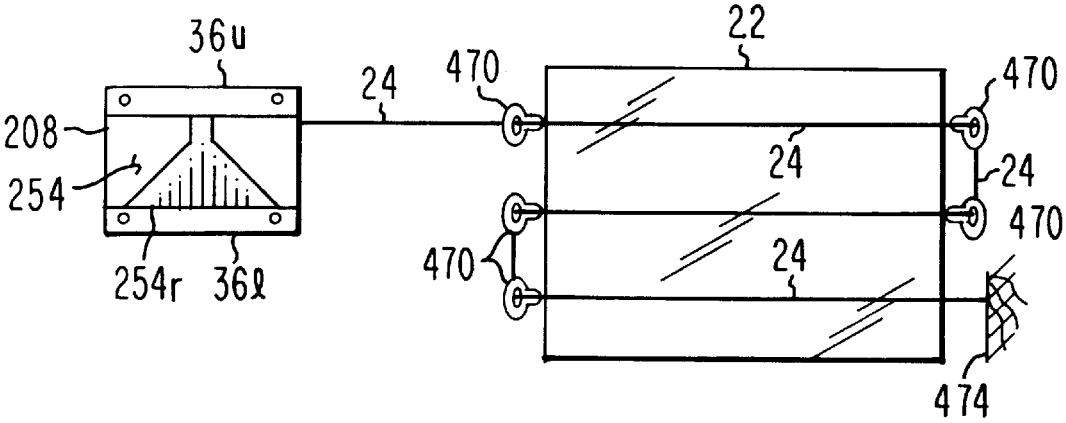

FIGS. 4*a*, 4*b*, and 4*c* illustrate further steps involved in setting up a structure such as that of FIGS. 2*a*, 2*b*, 2*c*, 2*d*, and 2*e*, following the steps illustrated in FIGS. 3*a*, 3*b*, 3*c*, and 3*d*. In FIG. 4*a*, the unit 208 is mounted on the wall (not numbered) by way of its flanges 36*u* and 36*l*. The alignment piece 250 is held in place by grooves 252*a* and 252*b* (of FIGS. 2*a*, 2*d*, and 2*e*) engaging tracks or rails 248*a* and 248*b*, respectively, so the projecting boss 212 engages the neck 255*n* of ramp 254*r*, and magnet 10 on its track follower 210 is centered on the reed switch 16. With the ramp side of the alignment device facing inward in FIGS. 4*a*, and 4*b*, flat side 253 of the alignment device is visible from the outside. As also illustrated in FIG. 4*a*, this further step involves placing eyehooks or other low-friction devices 470 at various locations along the intended path 472 of the filament 24. With the eyehooks in place, the filament 24 is strung through the eyehooks as illustrated in FIG. 4*b*, and fastened securely to a fixed object 474, which may be simply a nail set into the window frame. A substantial tension may be applied during the fastening of the end of filament 24, as the track follower cannot move, due to its being located in the neck of the ramp of the alignment device.

FIG. 4*c* illustrates the last step in setting up the switch adjacent to window 22. As illustrated, the alignment device has been removed, and reinstalled with the ramp side outward. In this state, the boss 212 associated with track follower 210 (FIGS. 2*a*, 2*b*, 2*c*, 2*d*, and 2*e*) is no longer engaged with any portion of the ramp 254*r*, and particularly not with the neck 255*n*, so the boss 212 and track follower 210 are no longer constrained, but are free to move along track 214. When the alignment device is removed, and the track follower is free to move, its position is determined by the two countervailing forces provided by the force of spring 30 and the tension in filament 24. Since the filament is nonelastic, the tension in the filament will become equal to the force of the spring with little or no change in the length of the filament. Consequently, the position of the track follower will not substantially change when the alignment device is removed. The alignment device may be lost if it is not attached to the remainder of the arrangement, so it is reinstalled on the body 208 with the flat side 253 facing inward. In that position, it also has the advantage of acting as a dust cover for the described apparatus.

If an attempt is made to enter the window 22 of FIG. 4*c*, the filament will either be stretched, pulling the magnet carrying track follower toward one end of the track, thereby tripping the magnetic switch, or the filament is cut, thereby allowing the track follower to move toward in the other direction, thereby also tripping the switch.

Figure 5A:
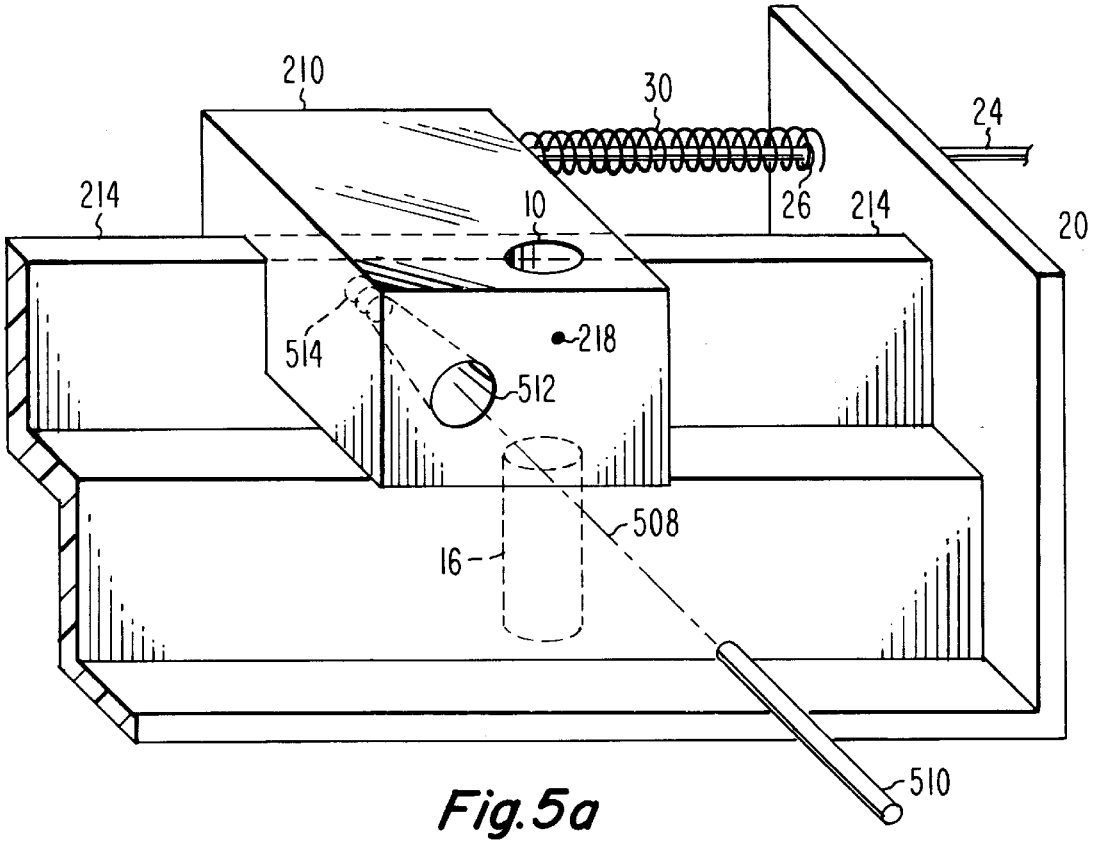
FIG. 5*a* represents a simplified perspective or isometric view of a portion of another embodiment of the invention in which the magnet carriage or track follower has a tapered aperture.
Figure 5B:
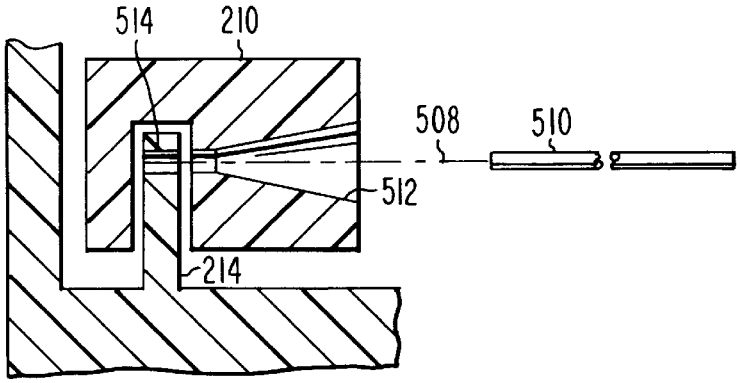
FIG. 5*b* is a cross-section of a magnet carriage or track follower, taken at the location of a tapered aperture.

FIG. 5*a* represents a simplified perspective or isometric view of a portion of another embodiment of the invention, and FIG. 5*b* is a cross-section of a magnet carriage or track follower, taken at the location of a tapered aperture. The structure illustrated in FIG. 5*a* is similar to that illustrated in FIG. 2*a*, but lacks the alignment device 250. Instead of the ramp structure associated with alignment device 250, the arrangement of FIG. 5*a* has an aperture 512 in the magnet carriage 210 which is aligned with an aperture 514 in track 214 when magnet 10 is adjacent location 218, corresponding to the location of the magnet carrier 210 at which magnet 10 is closest to magnetically actuated switch 16. A locking pin 510 is provided, and is dimensioned to fit through apertures 512 and 514 when the two apertures are aligned with pin axis 508. In the particular embodiment illustrated in FIGS. 5*a* and 5*b*, the aperture 512 in the magnet carrier is tapered, so as to have its larger dimension at the pin insertion end, and a diameter only slightly larger than the pin diameter adjacent the track 214. Similarly, aperture 514 in the track should be only slightly larger than the pin diameter, and may also be slightly tapered, to make insertion of the pin easy without excessive alignment effort. In use, the pin is used to lock the magnet carriage in place during installation of the switch assembly. It should be noted that aperture 512 in the magnet carrier is offset from the center of magnet 10, and the corresponding aperture 514 in the track 214 is somewhat offset from location 218, so that the magnet 10 is at location 218 when the pin 510 transfixes magnet carrier 210 at aperture 512 and track 214 at aperture 514. This offset avoids the need to drill the magnet, or to otherwise define an aperture therethrough, to accommodate the pin. The salient requirement is that the magnet carriage be fixed at a location which places magnet 10 sufficiently close to switch 16 to maintain the switch in one of its two states, such as the conductive or closed state of a normally-open switch.

Other embodiments of the invention will be apparent to those skilled in the art. For example, while the magnet has been described as a permanent magnet, a coil-and-current-source could conceivably be used, although the need to supply current to such a coil to maintain a magnetic field may be undesirable. While the magnet has been described as moving along a straight path, it could be mounted in such a manner as to follow a curved path, as by being mounted on the end of a pivoted arm. While a coil spring has been described for providing spring tension tending to drive the magnet toward one end of the path, other types of springs, such as straight springs, could be used. In one embodiment of the invention produced during development of the described embodiment, the spring in a rotary version used a negator spring, which has an inherent tendency to roll up into a tight spiral, as a conventional steel rule does. In addition, the energy storage could be provided, if desired, by structures other than springs, such as, for example, elastomeric elements, pneumatic or hydraulic cylinders, and the like. In particular, the energy storage could be provided by the mass of the magnet or of the magnet and its carriage, so long as the path along which the carriage rides has a vertical component near the location of the switch, thereby allowing a potential reduction in the material costs associated with manufacture by elimination of a discrete spring, at the cost of more restricted installation. While simplicity of operation is achieved by moving the magnet relative to a fixed switch, it is possible to move the switch instead. While filament 24 is preferably a monofilament similar to Nylon fishing line, it could be of a conventional material such as cotton or wool, although these could be expected to be subject to rotting in a damp environment, or it could be a thin metallic wire, if suitably limp and corrosion resistant. While the alignment device 250 has been described as acting as a dust cover, it need not be used as such, but may be discarded, or used for some other purpose. It is desirable that any magnetically active or permeable materials used in the structure be either far from the magnet and magnetically actuated switch, or relatively small, so that they do not excessively perturb the magnetic fields. However, magnetically permeable materials may be placed near the switch in order to more effectively direct the magnetic fields of the magnet, when present at location 218, to the switch.

Thus, an electrical switch according to an aspect of the invention includes a magnetically actuated switch (16), such as a reed switch (16), and a permanent magnet (10). A path defining arrangement (14) is mechanically coupled (by track follower 210) to the permanent magnet (10), for allowing the magnet (10) to move in a defined path (14). A particular part of the path (14) lies adjacent to a portion of the reed switch (16). The particular part (18) of the path (14) is close enough to the reed switch (16) to actuate the switch (16). Consequently, or whereby, the magnet (10), when at a particular position (18) along the path (14), will cause the reed switch (16) to assume one of first (open) and second (closed) states. In a particular embodiment of the invention, the magnet (10), when at the particular position (18) along the path (14), causes a normally-open switch (16) to close. An energy storage arrangement (30) is coupled to at least the magnet (10), for urging the magnet (10) toward one end (220) of the path (14). In the particular embodiment, the energy storage arrangement (30) is mechanically coupled to the magnet (10) by way of a portion of a track follower (210). An elongated, nonelastic flexible actuator (24) is coupled to the magnet (10), for, in use, applying tension to the magnet (10) in a direction (to the right in the illustrations) which urges the magnet (10) toward the other end (20) of the path. This flexible actuator (24) may be a filament such as a fishing line. A removable holding arrangement (250, 510) is associated with the path defining arrangement (14), for holding the magnet (10) in the particular part of the path. This is particularly advantageous during setup of the switch (16).

The track, in one embodiment, is a raised ridge (214), which engages a slot (216) in a track follower (210), and the magnet (10) is mounted on or in the track follower (210). A preferred embodiment has a straight track. In the preferred embodiment, the energy storage arrangement (30) includes a coil spring bearing on the track follower (210) and on a bearing surface (20) fixed near an end of the path. Another embodiment (FIGS. 5*a*, 5*b*) uses a pin (510) engaging an aperture (512) in the magnet carriage (210) and another aperture (514) in the track (214) to hold the magnet carriage in the proper position.

An electrical switch (16) according to the invention includes (a) a magnetically actuated reed switch (16), (b) a permanent magnet (10), (c) a path defining arrangement (14) mechanically coupled to the permanent magnet (10) for allowing the magnet (10) to move in a defined path, a particular part of which path lies adjacent to a portion of the reed switch (16), which particular part (218) is located so that the magnet is close enough to the reed switch (16) to actuate the switch (16), whereby the magnet (10), at a particular position along the path will cause the reed switch (16) to assume one of first and second states, (d) an energy storage arrangement (30) coupled to at least the magnet (10) for urging the magnet (10) toward one end of the path, (e) an elongated, nonelastic flexible actuator (24) coupled to the magnet (10), for, in use, applying tension to the magnet (10) in a direction which urges the path defining arrangement (14) toward the other end of the path, and (f) a removable holding arrangement associated with the path defining arrangement (14), for holding the magnet (10) in the particular part of the path. A method according to the invention includes the steps of (A) mounting the switch (16) to a fixed structure adjacent the opening to be protected, (B) extending the filament across at least a portion of the opening, and fastening the remote end of the filament to a fixed structure, and (C) removing the removable arrangement. A particular mode of the method includes the further step of extending the filament around at least one low-friction arrangement and across another portion of the opening.

What is claimed is:

1. An electrical switch, comprising:

a magnetically actuated switch;

a permanent magnet;

path defining means mechanically coupled to said permanent magnet for allowing said magnet to move in a defined path, a particular part of which path lies adjacent to a portion of said magnetically actuated switch, which particular part is close enough to said magnetically actuated switch so that the magnetic fields of said magnet, when lying at said particular part of said path, actuate said magnetically actuated switch, whereby said magnet, at a particular position along said path will cause said magnetically actuated switch to assume one of first and second states;

energy storage means coupled to at least said magnet for urging said magnet toward one end of said path;

an elongated, nonelastic flexible actuator coupled to at least said magnet, for, in use, applying tension to said magnet in a direction which urges said magnet toward an other end of said path; and removable holding means associated with said path defining means, for, when present, holding said magnet at said particular part of said path, and for, when not present, allowing said magnet to move along said path under the influence of said energy storage means and said actuator.

2. An electrical switch according to claim 1, wherein said magnetically actuated switch is a reed switch.

3. An electrical switch according to claim 1, wherein said path defining means comprises a track and a track follower bearing said magnet.

4. An electrical switch according to claim 3, wherein said track is straight.

5. An electrical switch according to claim 3, further comprising a bearing surface adjacent to an end of said path, and wherein;

said energy storage means comprises a coil spring bearing on said track follower and said bearing surface.

6. An electrical switch comprising:

a magnetically actuated switch;

a permanent magnet;

path defining means mechanically coupled to said permanent magnet for allowing said magnet to move in a defined path, a particular part of which path lies adjacent to a portion of said magnetically actuated switch, which particular part is close enough to said magnetically actuated switch so that magnetic fields of said magnet, when lying at said particular part of said path actuate said magnetically actuated switch, whereby said magnet, at a particular position along said path will cause said magnetically actuated switch to assume one of first and second states;

energy storage means coupled to at least said magnet for urging said magnet toward one end of said path;

an elongated, nonelastic flexible actuator coupled to at least said magnet for, in use, applying tension to said magnet in a direction which urges said magnet toward an other end of said path;

removable holding means associated with said path defining means, for holding said magnet at said particular part of said path;

a projecting boss associated with said magnet; and wherein said removable means comprises a ramp arrangement engaging said boss for tending to urge said magnet toward said particular part of said path.

7. An electrical switch, comprising:

a magnetically actuated switch;

a permanent magnet;

path defining means mechanically coupled to said permanent magnet for allowing said magnet to move in a defined path, a particular part of which path lies adjacent to a portion of said magnetically actuated switch, which particular part is close enough to said magnetically actuated switch so that magnetic fields of said magnet, when lying at said particular part of said path, actuate said magnetically actuated switch, whereby said magnet, at a particular position along said path will cause said magnetically actuated switch to assume one of first and second states;

energy storage means coupled to at least said magnet for urging said magnet toward one end of said path;

an elongated, nonelastic flexible actuator coupled to at least said magnet, for, in use, applying tension to said magnet in a direction which urges said magnet toward an other end of said path;

removable holding means associated with said path defining means, for holding said magnet at said particular part of said path;

a first aperture associated with said magnet;

a second aperture associated with a structure fixed in relation to said path defining means, said first and second apertures being coaxial when said magnet is near said particular part of said path; and wherein said removable holding means comprises rigid elongated means dimensioned to extend coaxially through said first and second apertures and removably mounted for holding said magnet near said particular part of said path.

8. A method for installing an electrical switch for protection of an opening, said electrical switch comprising:

a magnetically actuated switch;

a permanent magnet;

path defining means mechanically coupled to said permanent magnet for allowing said magnet to move in a defined path, a particular part of which path lies adjacent to a portion of said magnetically actuated switch, which particular part is close enough to said magnetically actuated switch so that said magnet, at said particular position along said path, will cause said magnetically actuated switch to assume one of first and second states;

energy storage means coupled to at least said magnet for urging said magnet toward one end of said path;

an elongated, nonelastic flexible actuator coupled to at least said magnet, for, in use, applying tension to said magnet in a direction which urges said magnet toward the other end of said path; and removable holding means associated with said path defining means, for holding said magnet in said particular part of said path, said method comprising the steps of:

mounting said electrical switch to a fixed structure adjacent said opening to be protected;

extending said filament across at least a portion of said opening, and fastening the remote end of said filament to a fixed structure; and removing said removable means.

9. A method according to claim 8, wherein said step of extending said filament further comprises the step of extending said filament around at least one low-friction arrangement and across another portion of said opening.

10. A method according to claim 8, further comprising the step of fastening said removable holding means to said electrical switch in a condition in which it fails to perform said holding function.

* * * * *